US006995521B2

(12) United States Patent
Okamura et al.

(10) Patent No.: US 6,995,521 B2
(45) Date of Patent: Feb. 7, 2006

(54) DRIVE CIRCUIT FOR PLASMA DISPLAY PANEL

(75) Inventors: Teruo Okamura, Tokyo (JP); Hiroshi Shirasawa, Tokyo (JP)

(73) Assignee: Pioneer Corporation, Tokyo (JP)

( * ) Notice: Subject to any disclaimer, the term of this patent is extended or adjusted under 35 U.S.C. 154(b) by 63 days.

(21) Appl. No.: 10/826,188

(22) Filed: Apr. 16, 2004

(65) Prior Publication Data

US 2004/0196217 A1 Oct. 7, 2004

Related U.S. Application Data

(63) Continuation of application No. 09/814,644, filed on Mar. 22, 2001.

(30) Foreign Application Priority Data

Mar. 23, 2000 (JP) ..... 2000-082575

(51) Int. Cl.
*G09G 3/10* (2006.01)

(52) U.S. Cl. ..... 315/169.4; 345/60; 345/67

(58) Field of Classification Search ..... 315/169.4; 345/55, 61, 67, 69, 60, 78
See application file for complete search history.

(56) References Cited

U.S. PATENT DOCUMENTS 5,654,728 A * 8/1997 Kanazawa et al. ..... 345/68
5,828,353 A * 10/1998 Kishi et al. ..... 345/55
5,943,030 A * 8/1999 Minamibayashi ..... 345/60
6,011,355 A * 1/2000 Nagai ..... 315/169.3
6,072,447 A * 6/2000 Noborio ..... 345/60
6,195,072 B1 * 2/2001 Iwami et al. ..... 345/67
6,483,487 B2 * 11/2002 Iseki ..... 345/60
6,538,627 B1 * 3/2003 Whang et al. ..... 345/60
6,567,059 B1 * 5/2003 Ide et al. ..... 345/60
2001/0026254 A1 * 10/2001 Ide et al. ..... 345/60

FOREIGN PATENT DOCUMENTS

JP 10-149131 6/1998
JP 10-319893 12/1998
JP 11-344952 12/1999

* cited by examiner

*Primary Examiner*—Thuy V. Tran
*Assistant Examiner*—Chuc Tran
(74) *Attorney, Agent, or Firm*—Drinker Biddle & Reath LLP

(57) ABSTRACT

Two sustain driver circuits are provided: a first sustain driver circuit for both controlling the potential on the scan electrode side and effecting control such that, when the scan electrode side is at the power-supply potential, this potential is used to raise the potential on the sustain electrode side; and a second sustain driver circuit for both controlling the potential on the sustain electrode side and effecting control such that, when the sustain electrode side is at the power-supply potential, this potential is used to raise the potential of the scan electrode side. When the scan electrode side is at the power-supply potential, control is effected such that current flows from the first sustain driver circuit to the second sustain driver circuit by way of a third switching element and first coil, whereby the potential of the scan electrode side falls and the potential of the sustain electrode side rises. When the sustain electrode side is at the power-supply potential, on the other hand, control is effected such that current flows from the second sustain driver circuit to the first sustain driver circuit by way of a sixth switching element and a second coil, whereby the potential of the sustain electrode side falls and the potential of the scan electrode side rises.

20 Claims, 9 Drawing Sheets

DRIVE CIRCUIT FOR PLASMA DISPLAY PANEL

CROSS REFERENCE TO RELATED APPLICATION

This application is a continuation of U.S. application Ser. No. 09/814,644, filed Mar. 22, 2001.

BACKGROUND OF THE INVENTION

1. Field of the Invention

The present invention relates to the drive circuit of a plasma display panel, and more particularly to the drive circuit of a plasma display panel that can limit the concentration of elements that generate heat during charge recovery.

2. Description of the Related Art

Generally, plasma display panels offer the advantages of thin structure, freedom from flicker, a high display contrast ratio, the relative ease of production in a large-screen format, rapid response speed, and the capability for multicolor light emission through the use of phosphors in spontaneous light emission forms. The use of plasma display panels is consequently becoming more widespread in recent years in the fields of large public display devices and in color television.

As shown in FIG. 1, an example of the prior art is constituted by panel 608 for display light emission and a drive circuit for controlling the display content and display luminance of panel 608.

Panel 608 is made up of pairs of main electrodes composed of scan electrodes 606-1~606-*n* and sustain electrodes 605-1~606-*n* that are arranged parallel to each other and data electrodes 607-1~607-N that extend perpendicular to these main electrodes. The main electrodes and data electrodes 607-1~607-N intersect in a matrix, each one of these intersecting portions forming a picture element.

In addition, the drive circuit of panel 608 is made up by: scan driver circuit 602 for driving scan electrodes 606-1~606-*n*; data driver circuit 604 for driving data electrodes 607-1~607-N; sustain driver circuit 601 for sustaining the emission of panel 608; and control circuit 603 for controlling scan driver circuit 602, data driver circuit 604, and sustain driver circuit 601. Control circuit 603 is made up by: scan driver control unit 609 for controlling scan driver circuit 602, data driver control unit 610 for controlling data driver circuit 604, and sustain driver control unit 611 for controlling sustain driver circuit 601.

In a plasma display panel that is configured according to the foregoing description, a display portion in panel 608 is first selected by scan electrodes 606-1~606-*n* and data electrodes 607-1~607-N (write discharge interval). Voltage is then alternately applied between scan electrodes 606-1~606-*n* and sustain electrodes 605-1~605-*n*, and the desired display is realized by the resulting discharge (sustain discharge interval). The luminance of the display is determined by the number of repetitions of the alternate application of voltage between scan electrodes 606-1~606-*n* and sustain electrodes 605-1~605-*n*.

The method of sustaining discharge by the exchange of charge between scan electrodes 606-1~606-*n* and sustain electrodes 605-1~605-*n* in this way is referred to as the self-recovery method. In this self-recovery method, charge that is generated in the write discharge interval is also used in the sustaining discharge, and new charge therefore need not be generated when generating the sustaining discharge.

This method therefore has the advantage of enabling a reduction in power consumption.

As shown in FIG. 2, sustain driver circuit 601 shown in FIG. 1 is made up by: transistor Q702 for clamping sustain electrodes 605-1~605-*n* to the potential of power-supply voltage VS; transistor Q703 for clamping sustain electrodes 605-1~605-*n* to the ground potential; transistor Q706 for clamping scan electrodes 606-1~606-*n*~to the potential of the power-supply voltage VS; transistor Q707 for clamping scan electrodes~606-1~606-*n* to the ground potential; transistors Q704, Q705, and diodes D702 and D703 for controlling the exchange of charge between scan electrodes 606-1~606-*n* and sustain electrodes 605-1~605-*n*; coil L701; clamp diodes D705 and D707 for suppressing the pressure of the component withstand voltage margin by absorbing spike voltage caused by the counter-electromotive force in coil L701; clamp diodes D704 and D706 for absorbing spike voltage caused by the counter-electromotive force in parasitic inductance; transistor Q701 for applying a voltage VSW (>power-supply voltage VS) that is added to power-supply voltage VS during the write interval in order to facilitate generation of the sustaining discharge; and diode D701 for preventing the flow of a short circuit current between voltage VSW and power-supply voltage VS by way of transistor Q702 due to voltage VSW in cases in which voltage VSW is applied. In this case, point A is the connection point transistors Q706 and Q707; point B is the connection point between the cathode of diode D701 and transistor Q703; and point C is the connection point between the anode of diode D704 and the cathode of diode D706. Panel capacitance C701 is arranged between point A and point B. Scan electrode Y1 is arranged on the point A side of panel capacitance C701, and sustain electrode X1 is arranged on the point B side of panel capacitance C701. X1 and Y1 correspond to X and Y, respectively, shown in FIG. 1.

Next, regarding the operation during the sustaining discharge interval, in the write discharge interval, voltage is applied between scan electrodes 606-1~606-*n* and data electrodes 607-1~607-N based on the display content, whereby charge moves and discharge is generated between the scan electrodes and data electrodes of a portion based on the display content.

Next, panel capacitance C701 is charged when transistors Q702 and Q707 turn ON.

Turning transistors Q702 and Q707 OFF and then turning transistor Q7040N causes panel capacitance C701 and coil L701 to form a resonance circuit, and the charge that has accumulated in panel capacitance C701 flows out as a resonance current and recharges panel capacitance C701 to reverse polarity by way of coil L701.

In FIG. 2, parasitic inductance cannot be ignored if the wiring length between points A and C is lengthened.

Turning now to FIG. 3, an explanation is presented regarding the charge recovery method in sustaining driver circuit that is configured according to the above description.

As the initial state, transistors Q703 and Q706 are each in an ON state, whereby the scan electrode side (point A) is at the potential of power-supply voltage VS and the sustain electrode side (point B) is at the ground potential.

From this state, transistors Q703 and Q706 are set to the OFF state, following which transistor Q705 is placed in the ON state.

A current thereupon flows from the scan electrode side to the sustain electrode side by way of transistor Q705, diode D702, and coil L701, whereby the potential level on the scan electrode side drops and the potential level on the sustain electrode side rises. Here, the slope of the curve of this fall and rise in the potential levels is determined by the resonance period of the product of the inductance of coil L701 and parasitic inductance of the wiring and panel capacitance C701.

After the potential level on the scan electrode side has fallen a certain amount and the potential level on the sustain electrode side rises a certain amount, transistors Q702 and Q707 are placed in the ON state, whereby the potential level of the scan electrode side is clamped to the ground potential and the potential level of the sustain electrode side is clamped to the potential of power-supply voltage VS.

Transistors Q702 and Q707 are next placed in the OFF state, following which transistor Q704 is placed in the ON state.

A current then flows from the sustain electrode side to the scan electrode side by way of coil L701, diode D703 and transistor Q704, whereby the potential level of the sustain electrode side falls and the potential level of the scan electrode side rises.

After the potential level of the sustain electrode side has fallen a certain amount and the potential level of the scan electrode side has risen a certain amount, transistors Q703 and Q706 are placed in the ON state, whereby the potential level of the sustain electrode side is clamped to the ground potential, and the potential level of the scan electrode side is clamped to the potential of power-supply voltage VS.

Self recovery of charge is realized by thus controlling transistors Q702~Q707 such that the potential on the scan electrode side and the potential on the sustain electrode side shift and charge is exchanged between the scan electrodes and sustain electrodes.

Sustaining driver circuit 601, which is disclosed in Japanese Patent Laid-open No. 344952/1999 and shown in FIG. 4, is made up by: transistor Q901 for clamping sustain electrodes 605-1~**605-*n* to the potential of power-supply voltage VS; transistor Q902 for clamping sustain electrodes 605-1~605-*n* to the ground potential; transistor Q903 for clamping scan electrodes 606-1~606-*n* to the potential of power-supply voltage VS; transistor Q904 for clamping scan electrodes 606-1~606-*n* to the ground potential; transistors Q905 and Q906 and coil L901 that are connected together in a series between sustain electrodes 605-1~605-*n* and scan electrodes 606-1~606-*n*; diode D901 that is provided in parallel with transistor Q905; and diode D902 that is provided in parallel with transistor Q906. One end of each of transistors Q905 and Q906 is connected to the two ends of panel capacitance Cp. Coil L901 is arranged between transistors Q905 and Q906**.

Next, regarding the operation of the prior-art sustaining driver circuit that is shown in FIG. 4, in the initial state, all transistors Q901~Q906 are in the OFF state.

From this state, transistors Q901 and Q904 turn ON, whereupon panel capacitance Cp is charged.

Transistors Q901 and Q904 next turn OFF, following which transistor Q905 turns ON, whereupon panel capacitance Cp and coil L901 form a resonance circuit, the charge that has accumulated in panel capacitance Cp flows out as a resonance current, and panel capacitance Cp is recharged to reverse polarity by way of coil L901.

In this example of the prior art, the time during which transistors Q905 and Q906 are ON is adjusted to equal the resonance period of the product of panel capacitance Cp and coil L901.

In recent years, an increase in the sustaining discharge frequency is demanded as a means of improving the luminance of plasma display panels. In order to raise the sustaining discharge frequency, the period of the ON/OFF switching of the transistors is shortened in the sustaining driver circuit such as described hereinabove, whereby the period of shifting of the potential on the sustain electrode side and the potential on the scan electrode side must be shortened.

Raising the sustaining discharge frequency in a case in which the potential in the sustain electrodes and scan electrodes for sustaining discharge is controlled by a single sustaining driver circuit as described hereinabove increases the load on the sustaining driver circuit and gives rise to the problem of concentrated element heat generation. In the sustaining driver circuit shown in FIG. 4 in particular, whether the potential on the sustain electrode side is decreased and this potential is used to raise the potential of the scan electrode side, or the potential of the scan electrode side is decreased and this potential is used to raise the potential of the sustain electrode side, current flows to coil L901 and the generation of heat in coil L901 is considerable.

In the publication of Japanese Patent Laid-open No. 344952/1999, although it is disclosed that the damping resistor that is arranged in parallel with coil L901 can be eliminated if the timing of transistors Q905 and Q906 shown in FIG. 4 is regulated to equal the resonance frequency, in actuality, cases of divergence from the resonance period occur due to variation in the panel capacitance or discrepancies in the circuit elements, and the resulting counter-electromotive force necessitates the introduction of clamp diodes or damping resistance.

In the example shown in FIG. 2, moreover, parasitic inductance exists between points A and C apart from coil L701. The reasons for the existence of this parasitic inductance include:

the arrangement of each clamp switch that is arranged in the vicinity of the panel for reducing the parasitic impedance between clamp switches and electrodes; and the increase in parasitic inductance that accompanies the increase in wiring length between points A and C with increase in screen size.

Clamp diodes D704 and D706 must be provided to absorb the spike voltage that is caused by counter-electromotive force in this parasitic inductance. In addition, although clamp diodes D705 and D707 are provided to absorb the spike voltage that is caused by the counter-electromotive force in coil L701, in actuality, diode D707 cannot be provided because in cases in which voltage VSW is applied to diode D707, voltage VSW causes a short circuit current to flow between voltage VSW and power-supply voltage VS by way of diode D707. In such a case, spike voltage occurs that is caused by the counter-electromotive force in coil L701. Although it is possible to use a switch in place of diode D707 that turns OFF when VSW is applied, this solution entails higher costs.

SUMMARY OF THE INVENTION

It is an object of the present invention to provide a drive circuit for a plasma display panel that can both realize the dispersion of element heat generation and suppress the pressure of the component withstand margin by absorbing spike voltage that is caused by counter-electromotive force in coils and parasitic inductance.

In the present invention, two sustain driver circuits are provided: a first sustain driver circuit for both controlling the potential of the scan electrode side and realizing control such that, when the scan electrode side is the power-supply potential, this potential is used to raise the potential of the sustain electrode side; and a second sustain driver circuit for both controlling the potential of the sustain electrode side and realizing control such that, when the sustain electrode side is at the power-supply potential, this potential is used to raise the potential of the scan electrode side. When the scan electrode side is at the power-supply potential, control is effected such that current flows from the first sustain driver circuit to the second sustain driver circuit by way of a third switching element and a first coil, whereby the potential of the scan electrode side falls and the potential of the sustain electrode side rises. Further, when the sustain electrode side is at the power-supply potential, control is effected such that current flows from the second sustain driver circuit to the first sustain driver circuit by way of a sixth switching element and a second coil, whereby the potential of the sustain electrode side falls and the potential of the scan electrode side rises.

In this way, control of potential between sustain electrodes and scan electrodes that employs the potential of the partner electrodes is realized by dividing control between two sustain driver circuits according to the direction in which current flows, thereby dispersing the heat-generating elements.

In addition, a group of clamp diodes absorbs the spike voltage that is caused by the counter-electromotive force that is in the inductance that is present in the first and second coil as well as in the junction means. At such times, the provision of first and second diodes that are provided on the first and second switching element side or on the fourth and fifth switching element side from the clamp diode group and that regulate the direction of current that flows between the first sustain driver circuit and second sustain driver circuit to one direction prevents the flow of current to the power-supply potential due to voltage that is higher than the power-supply voltage.

The above and other objects, features, and advantages of the present invention will become apparent from the following description based on the accompanying drawings which illustrate examples of preferred embodiments of the present invention.

DETAILED DESCRIPTION OF THE PREFERRED EMBODIMENTS

First Embodiment

Figure 5:
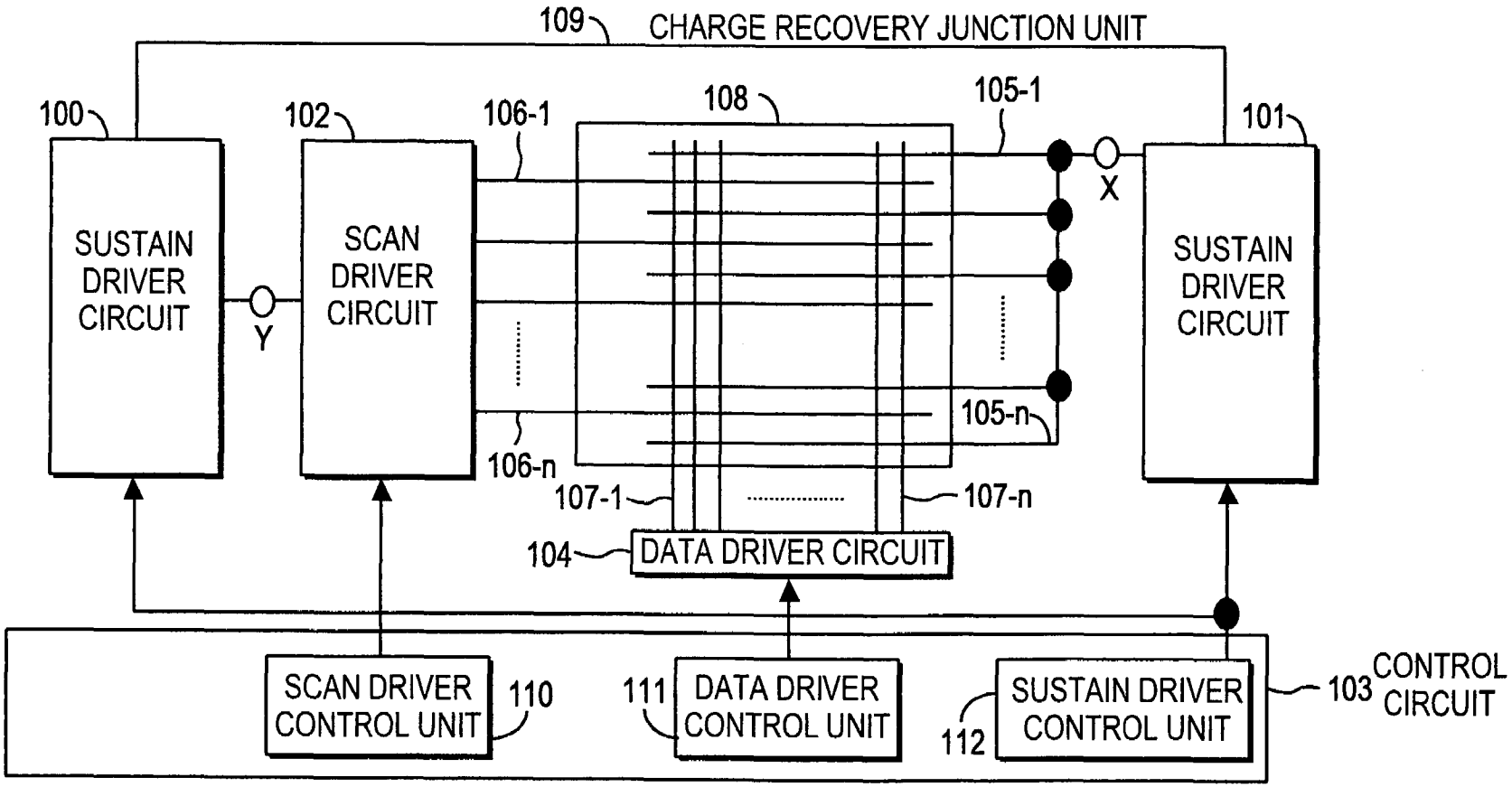
FIG. 5 is an explanatory view of the first embodiment of the plasma display panel drive circuit of the present invention.

As shown in FIG. 5, the plasma display panel used in the present invention is made up by panel 108 that emits light for display and a drive circuit for controlling the display content and display luminance of panel 108.

Panel 108 is constituted by a pair of main electrodes composed of scan electrodes 106-1~**106-*n* and sustain electrodes 105-1~105-*n* that are arranged parallel to each other, and data electrodes 107-1~107-N that extend in a direction that is perpendicular to the main electrodes; the main electrodes and data electrodes 107-1~107**-N intersecting with each other in a matrix, and the intersecting portions each being picture elements.

In addition, the drive circuit of panel 108 is made up by: scan driver circuit 102 for driving scan electrodes 106-1~**106-*n*; data driver circuit 104 for driving data electrodes 107-1~107-N; first sustain driver circuit 100 that controls switching to lower the potential of the side of scan electrodes 106-1~106-*n* and raise the potential of the side of sustain electrodes 105-1~105-*n*; second sustain driver circuit 101 that controls switching to lower the potential on the side of sustain electrodes 105-1~105-*n* and raise the potential on the side of scan electrodes 106-1~106-*n*; control circuit 103 for controlling scan driver circuit 102, data driver circuit 104 and sustain driver circuits 100 and 101; and charge recovery junction unit 109 for connecting sustain driver circuit 100 and sustain driver circuit 101. Control circuit 103 is constituted by: scan driver control unit 110 for controlling scan driver circuit 102; data driver control unit 111 for controlling data driver circuit 104; and sustain driver control unit 112 for controlling sustain driver circuits 100 and 101**.

Two sustain driver circuits 100 and 101 are provided in the present embodiment as described in the foregoing explanation, and the control of switching charge between sustain electrodes 105-1~**105-*n* and scan electrodes 106-1~106-*n* is divided between the two sustain driver circuits 100 and 101** according to the direction of charge movement.

Figure 6:
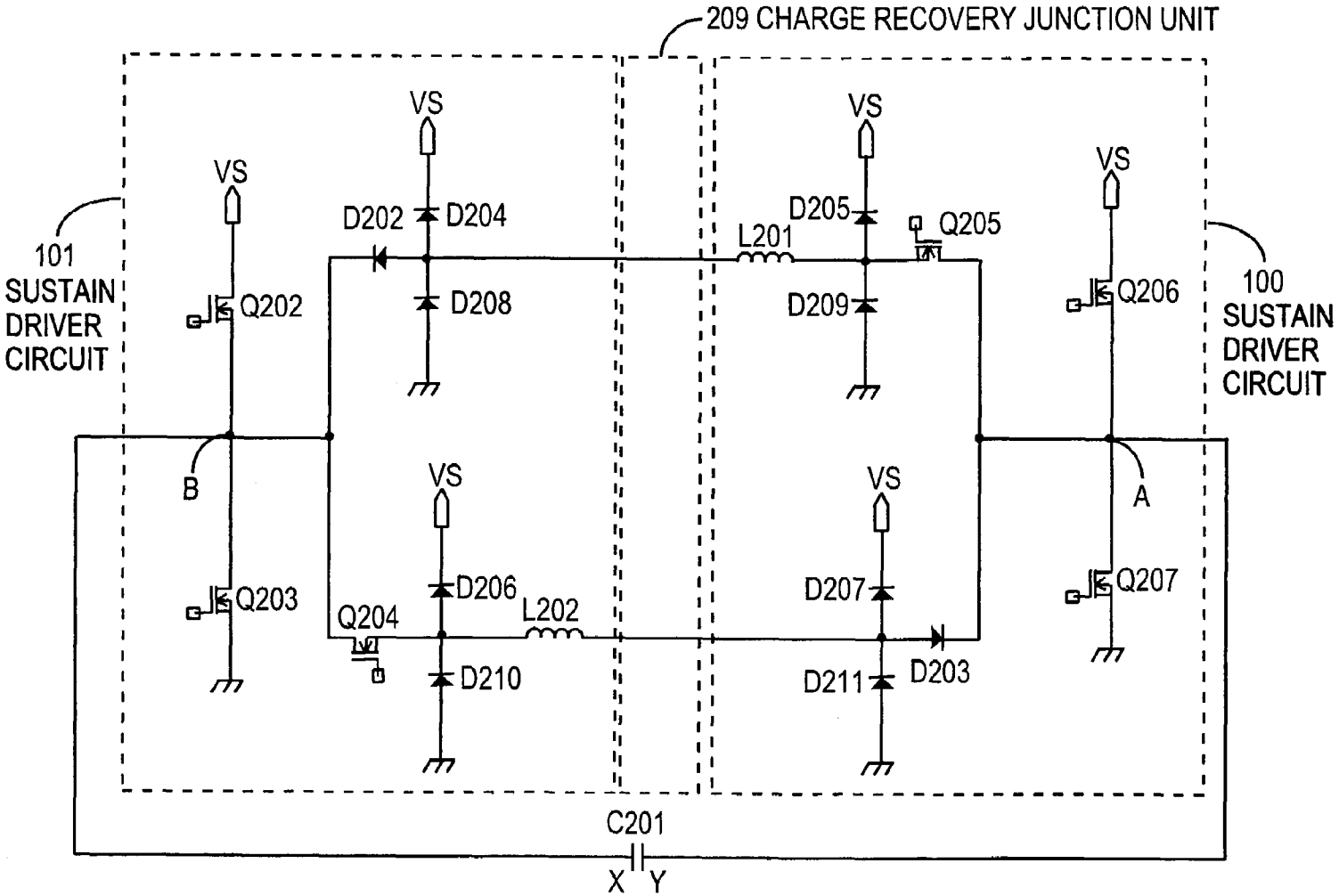
FIG. 6 is a circuit diagram showing the first embodiment of the plasma display panel drive circuit of the present invention.

As shown in FIG. 6, the first embodiment of the plasma display panel drive circuit of the present invention is configured such that sustain driver circuit 100 and sustain driver circuit 101 shown in FIG. 5 connect with each other by way of two paths at charge recovery junction unit 209.

Furthermore, as shown in FIG. 6, sustain driver circuit 100 in this embodiment is made up by: transistor Q206, which is a first switching means for clamping scan electrodes 106-1~**106-*n* to the potential of power-supply voltage VS; transistor Q207, which is a second switching means for clamping scan electrodes 106-1~106-*n* to the ground potential; transistor Q205, which is a third switching means, for realizing the switching operation when reducing the potential on the scan electrode side and using this potential to raise the potential on the sustain electrode side; first coil L201 that is connected between transistor Q205 and sustain driver circuit 101; clamp diodes D205 and D209 for absorbing the spike voltage in sustain driver circuit 100 that arises from the counter-electromotive force in the parasitic inductance that is present in coil L201 and charge recovery junction unit 209; clamp diodes D207 and D211 for absorbing spike voltage in sustain driver circuit 100 that arises from counter-electromotive force in the parasitic inductance that is present in charge recovery junction unit 209 and coil L202 that is provided in sustain driver circuit 101; and first diode D203 for controlling the direction in which current flows such that current flows only from sustain driver circuit 101 by one path of the two paths that are connected to sustain driver circuit 101**.

Further, as shown in FIG. 6, sustain driver circuit 101 in this embodiment is made up of: transistor Q202, which is a fourth switching means for clamping sustain electrodes 105-1~**105-*n* to the potential of power-supply voltage VS; transistor Q203, which is a fifth switching means for clamping sustain electrodes 105-1~105-*n* to the ground potential; transistor Q204, which is a sixth switching means, for realizing the switching operation when reducing the potential on the sustain electrode side and using this potential to raise the potential on the scan electrode side; second coil L202 that is connected between transistor Q204 and sustain driver circuit 100; clamp diodes D206 and D210 for absorbing the spike voltage in sustain driver circuit 101 that arises from the counter-electromotive force in the parasitic inductance that is present in coil L202 and charge recovery junction unit 209; clamp diodes D204 and D208 for absorbing spike voltage in sustain driver circuit 101 that arises from counter-electromotive force in the parasitic inductance that is present in charge recovery junction unit 209 and coil L201 that is provided in sustain driver circuit 100; and second diode D202 for controlling the direction in which current flows such that current flows only from sustain driver circuit 100 by one path of the two paths that are connected to sustain driver circuit 100**.

The panel capacitance between scan electrodes 106-1~**106-*n* and sustain electrodes 105-1~105-*n* is indicated by C201**.

The clamp circuit on the sustain electrode side is formed from transistors Q202 and Q203, and the clamp circuit on the scan electrode side is formed from transistors Q206 and Q207.

Figure 7:
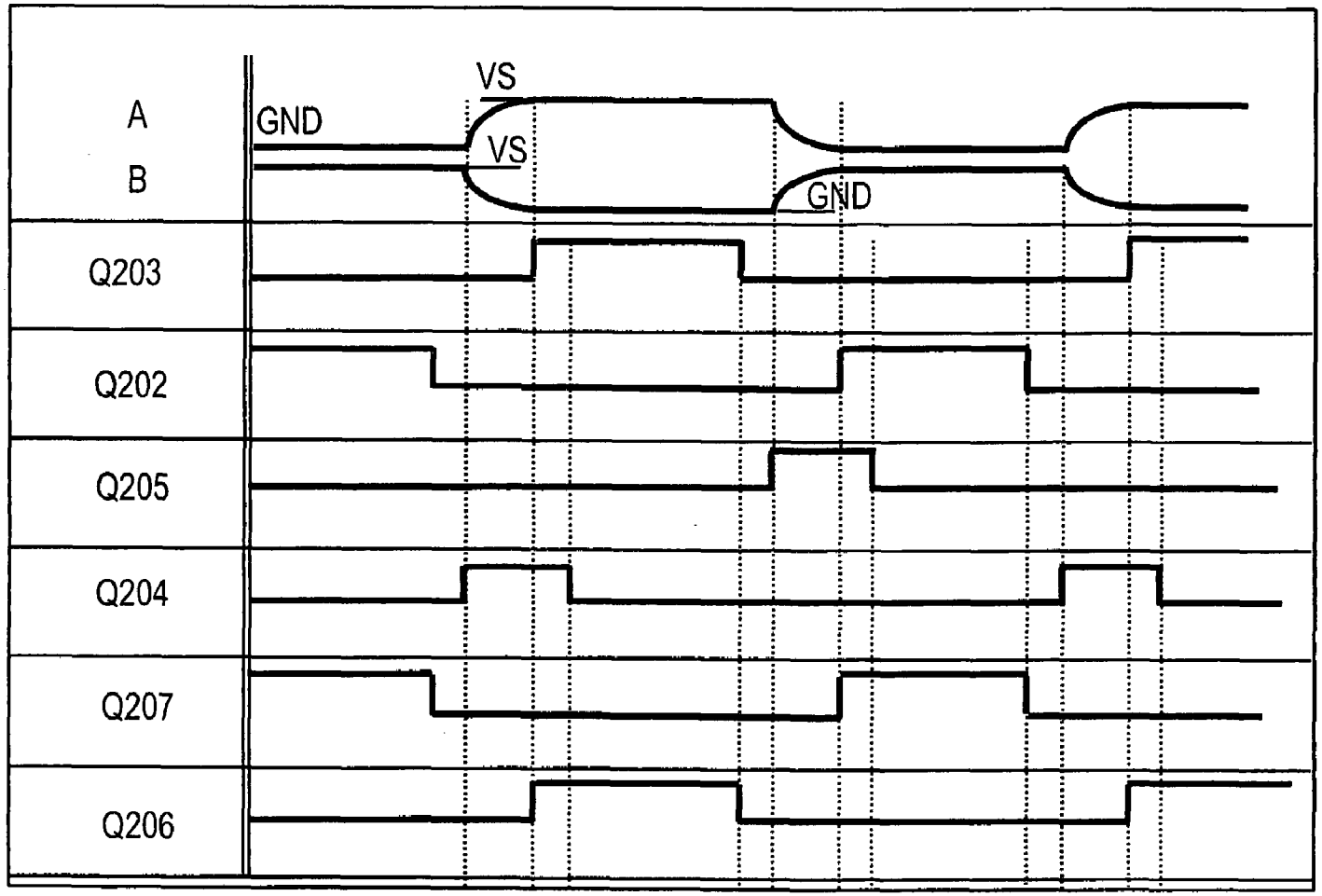
FIG. 7 is a timing chart for explaining the charge recovery method in the sustain driver circuit shown in FIG. 6.

Turning now to FIG. 7, the charge recovery method in the sustain driver circuit that is configured according to the foregoing description is next explained.

First, as the initial state, transistors Q202 and Q207 are each in the ON state, and the scan electrode side (point A) is therefore at the ground potential and the sustain electrode side (point B) is at the potential of power-supply voltage VS.

From this state, transistors Q202 and Q207 are first set to the OFF state, following which transistor Q204 is placed in the ON state.

A current thereupon flows from the sustain electrode side to the scan electrode side by way of transistor Q204, coil L202, and diode D203. The potential level on the sustain electrode side therefore falls and the potential level on the scan electrode side rises. Here, the slope of the curves of the fall and rise of the potential levels is determined by the resonance period of the product of multiplying the inductance of coil L202 and the parasitic inductance of the wiring with panel capacitance C201.

After the potential level of the sustain electrode side has fallen a certain amount and the potential level of the scan electrode side has risen a certain amount, transistors Q203 and Q206 are turned ON, whereby the potential level on the scan electrode side is clamped to the potential of power-supply voltage VS and the potential level of the sustain electrode side is clamped to the ground potential.

After the potential level of the scan electrode side has been clamped to the potential of power-supply voltage VS and the potential level of the sustain electrode side has been clamped to the ground potential, transistor Q204 is turned OFF.

Transistors Q203 and Q206 are next set to the OFF state, following which transistor Q205 is turned ON.

A current thereupon flows from the scan electrode side to the sustain electrode side by way of transistor Q205, coil L201, and diode D202. The potential level of the scan electrode side therefore falls and the potential level of the sustain electrode side rises.

After the potential level of the scan electrode side has fallen a certain amount and the potential level of the sustain electrode side has risen a certain amount, transistors Q202 and Q207 are turned ON, whereby the potential level of the sustain electrode side is clamped to the potential of power-supply voltage VS and the potential level of the scan electrode side is clamped to the ground potential.

Charge is exchanged between the scan electrodes and sustain electrodes and the self-recovery of electric charge is realized by repeating control such that the potential on the scan electrode side and the potential on the sustain electrode side shift as described in the foregoing explanation.

Here, the length of wiring in charge recovery junction unit 209 increases with increase in screen size of the plasma display panel or decrease in size of the mounting substrate, and the parasitic inductance component therefore increases. As a result, counter-electromotive force is generated in coil L201 at the time transistor Q205 is switched between ON and OFF. Although counter-electromotive force occurs in the parasitic inductance that is present in charge recovery junction unit 209, the spike voltage caused by these counter-electromotive forces is absorbed by clamp diodes D204, D205, D208, and D209.

Similarly, the spike voltage that is caused by the counter-electromotive force that arises at the parasitic inductance that is present in coil L202 and charge recovery junction unit 209 at the time transistor Q204 is switched between ON and OFF is absorbed by clamp diodes D206, D207, D210, and D211.

Thus, in the present embodiment, the control over the exchange of charge between sustain electrodes 105-1~**105-*n* and scan electrodes 106-1~106-*n* is divided between two sustain driver circuits 100 and 101**, thereby enabling: dispersion of the heat generated by elements during charge recovery, absorption of the spike voltage that arises from the counter-electromotive force that is caused by the coil and parasitic inductance, and suppression of the pressure of the component withstand margin.

Furthermore, the scan electrodes, the sustain electrodes, and clamp circuits for clamping these electrodes to a prescribed potential can all be arranged in proximity to each other, and transistors Q204 and Q205 that perform switching for charge recovery can be arranged in proximity to the scan electrodes and sustain electrodes, thereby enabling suppression of the inductance on the substrate between electrode Y and each of transistors Q205~Q207 and diode D203, or the inductance on the substrate between electrode X and each of transistors Q202~Q204 and diode D202. The spike voltage is therefore reduced, and in addition, the effect of distortion in the applied voltage of the panel caused by such factors as the panel resistance component can also be suppressed.

Second Embodiment

Figure 1:
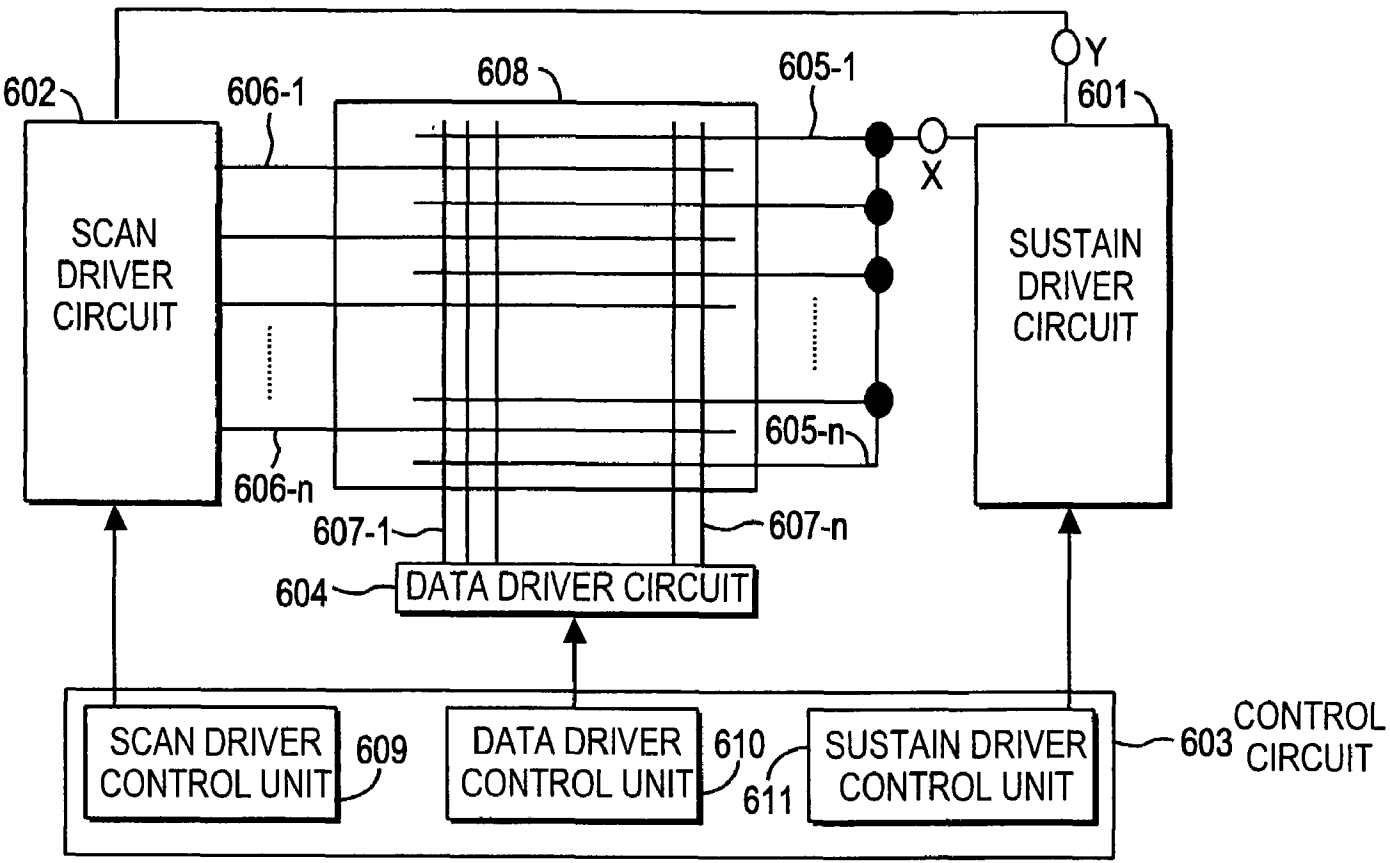
FIG. 1 (PRIOR ART)
FIG. 1 shows an example of the configuration of a prior-art plasma display panel.
Figure 2:
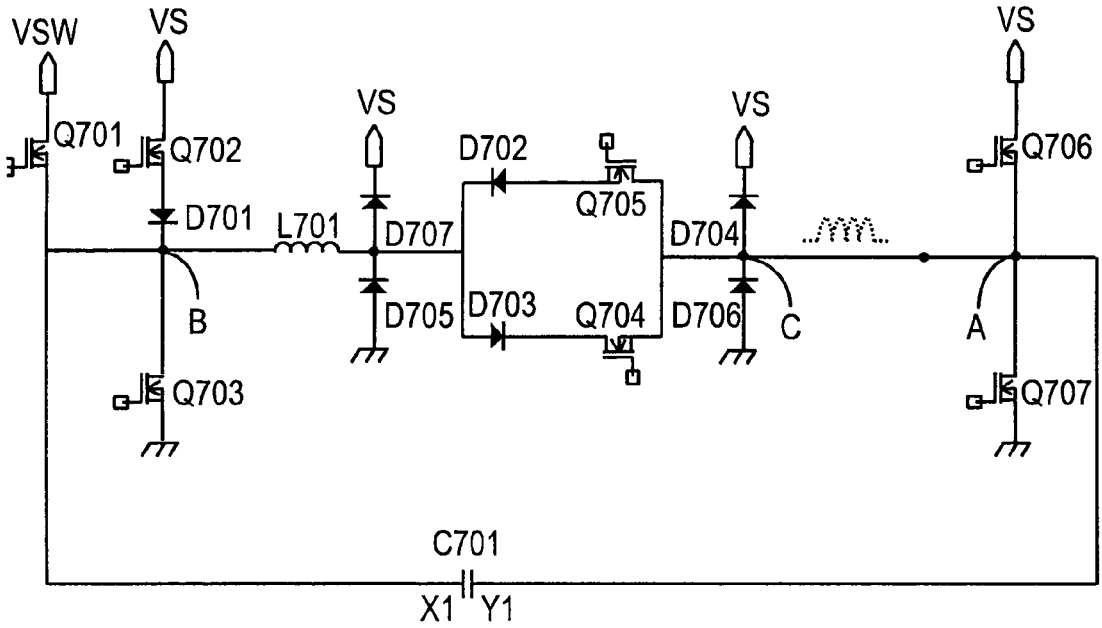
FIG. 2 (PRIOR ART)
FIG. 2 is an explanatory view of the self-recovery method of the prior art.
Figure 3:
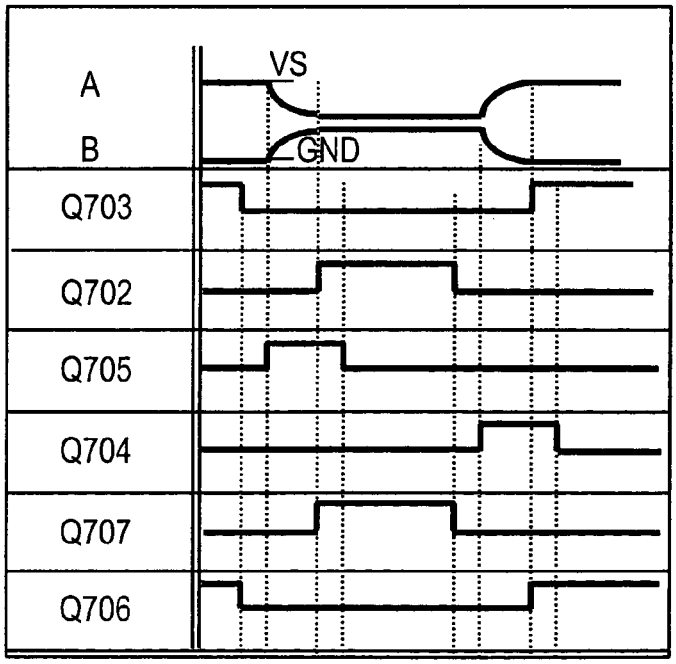
FIG. 3 (PRIOR ART)
FIG. 3 is a timing chart for explaining the charge recovery method in the sustain driver circuit shown in FIG. 2.
Figure 4:
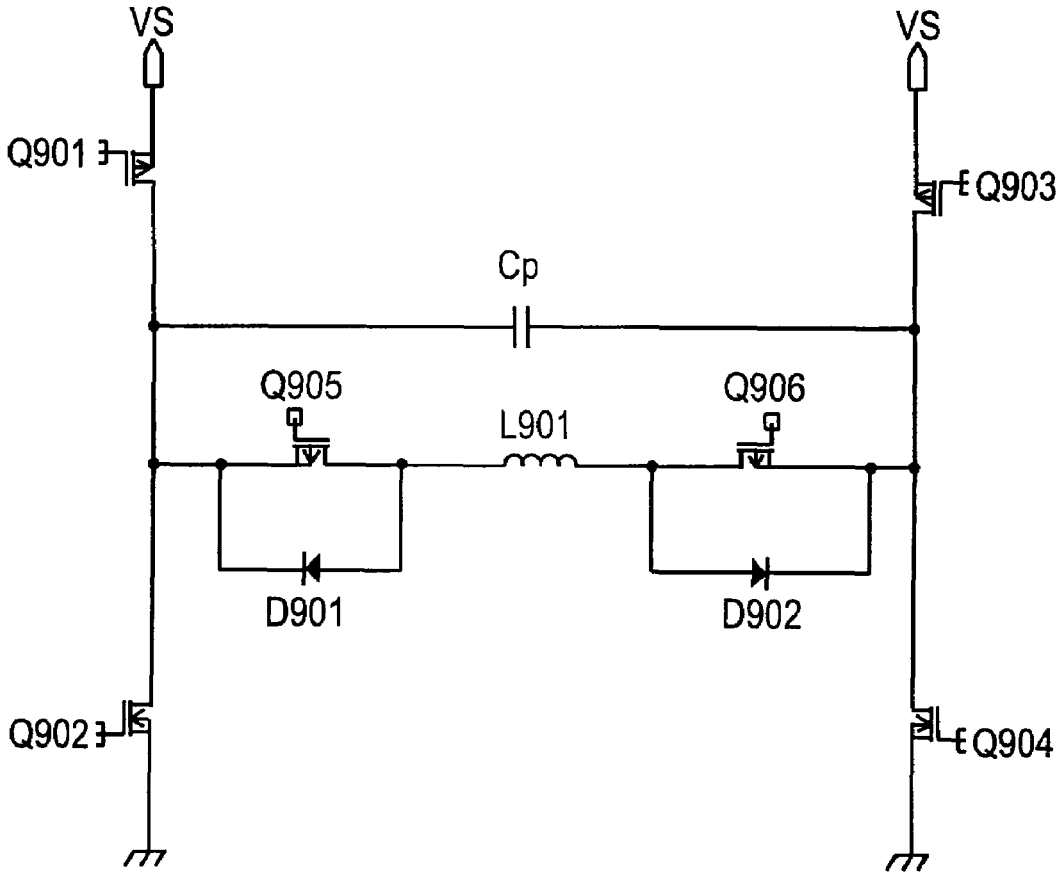
FIG. 4 (PRIOR ART)
FIG. 4 shows another example of the sustain driver circuit shown in FIG. 1.
Figure 8:
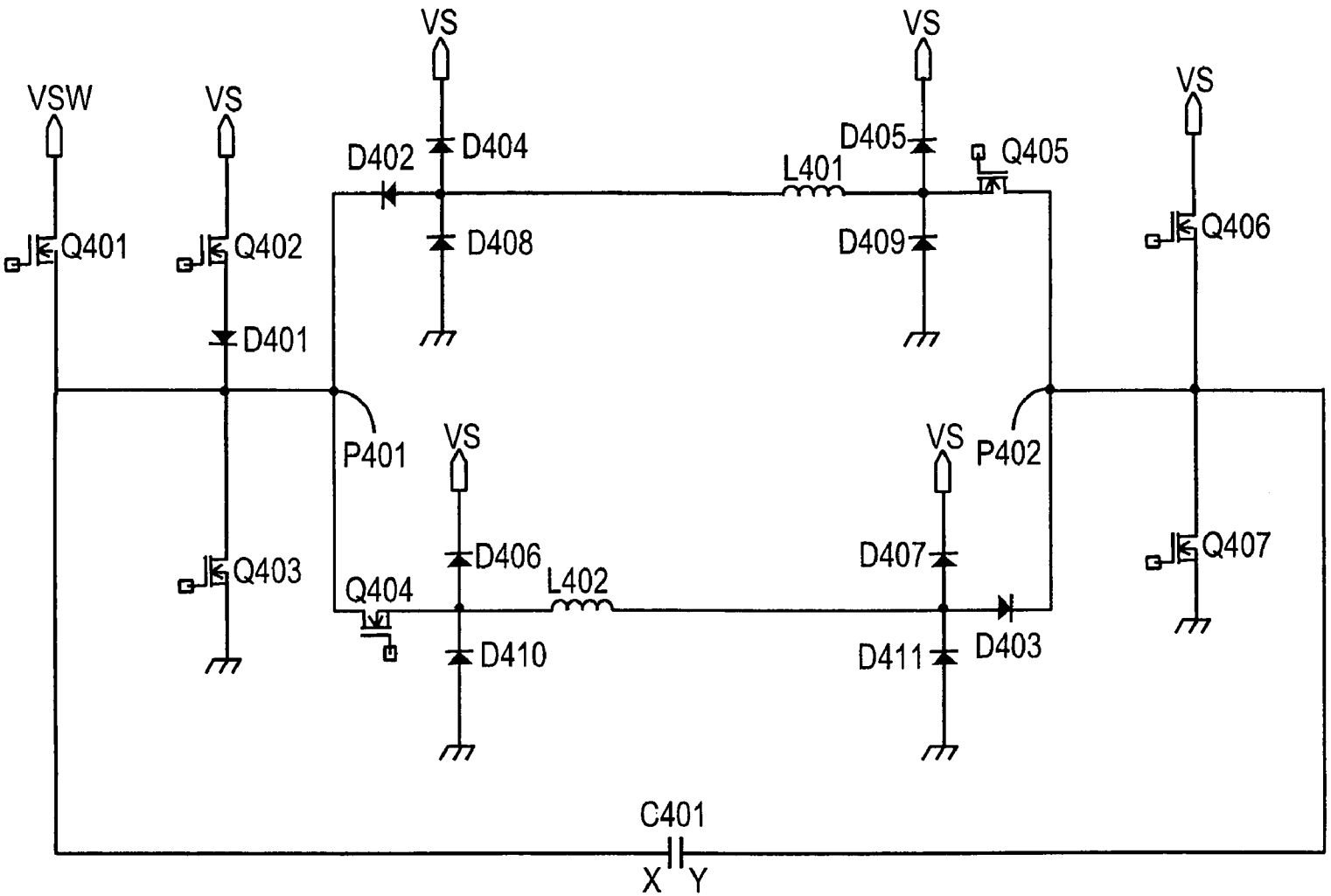
FIG. 8 is a circuit diagram showing the second embodiment of the plasma display panel drive circuit of the present invention.

As shown in FIG. 8 and in contrast to the circuit shown in FIG. 6, sustain driver circuits 100 and 101 in this embodiment are provided with: a terminal to which is applied voltage VSW, which is higher than power-supply potential VS; and transistor Q401 for controlling the application of voltage VSW, as in the example shown in FIG. 2.

In this embodiment, fourth diode D401 for preventing a short circuit current must be provided at either the drain or source of transistor Q402 to prevent the flow of short circuit current between voltage VSW and power-supply voltage VS by way of transistor Q402 in cases in which voltage VSW is applied. In addition, diode D402 or transistors Q403 and Q404 must be modified to elements that have a margin with respect to voltage VSW.

Third Embodiment

Figure 9:
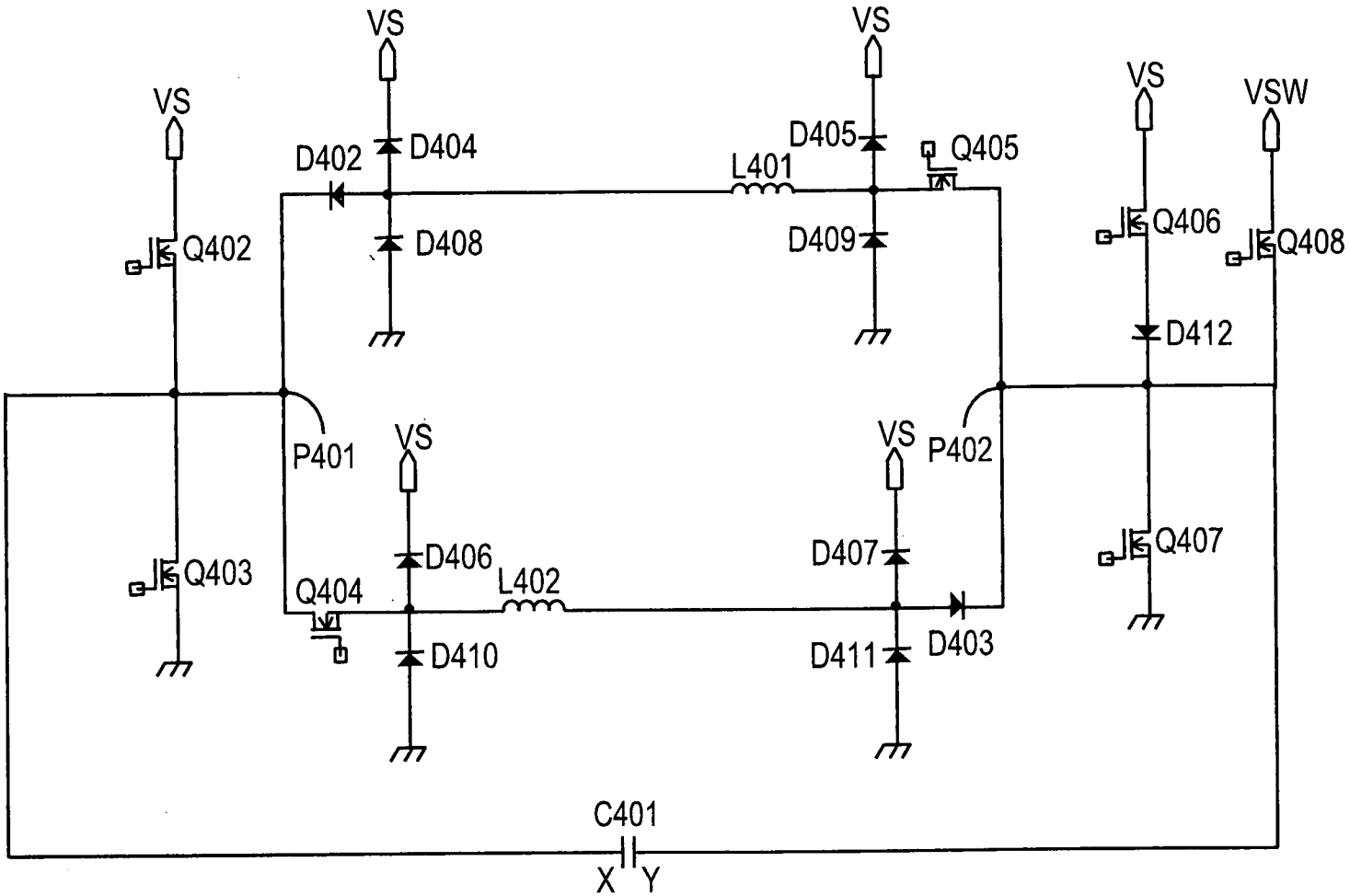
FIG. 9 is a circuit diagram showing the third embodiment of the plasma display panel drive circuit of the present invention.

As shown in FIG. 9 and in contrast to the circuit shown in FIG. 8, sustain driver circuits 100 and 101 in this embodiment are circuits in which voltage VSW is applied to the scan electrode side instead of to the sustain electrode side, and transistor Q408 is provided for controlling the application of voltage VSW.

In this embodiment, third diode D412 for preventing short circuit currents must be provided at either the drain or source of transistor Q406 to prevent the flow of short circuit current caused by voltage VSW between voltage VSW and power-supply voltage VS by way of transistor Q406 in cases in which voltage VSW is applied. Further, diode D403 and transistors Q405 and Q407 must be modified to elements that have a margin with respect to voltage VSW.

Fourth Embodiment

Figure 10:
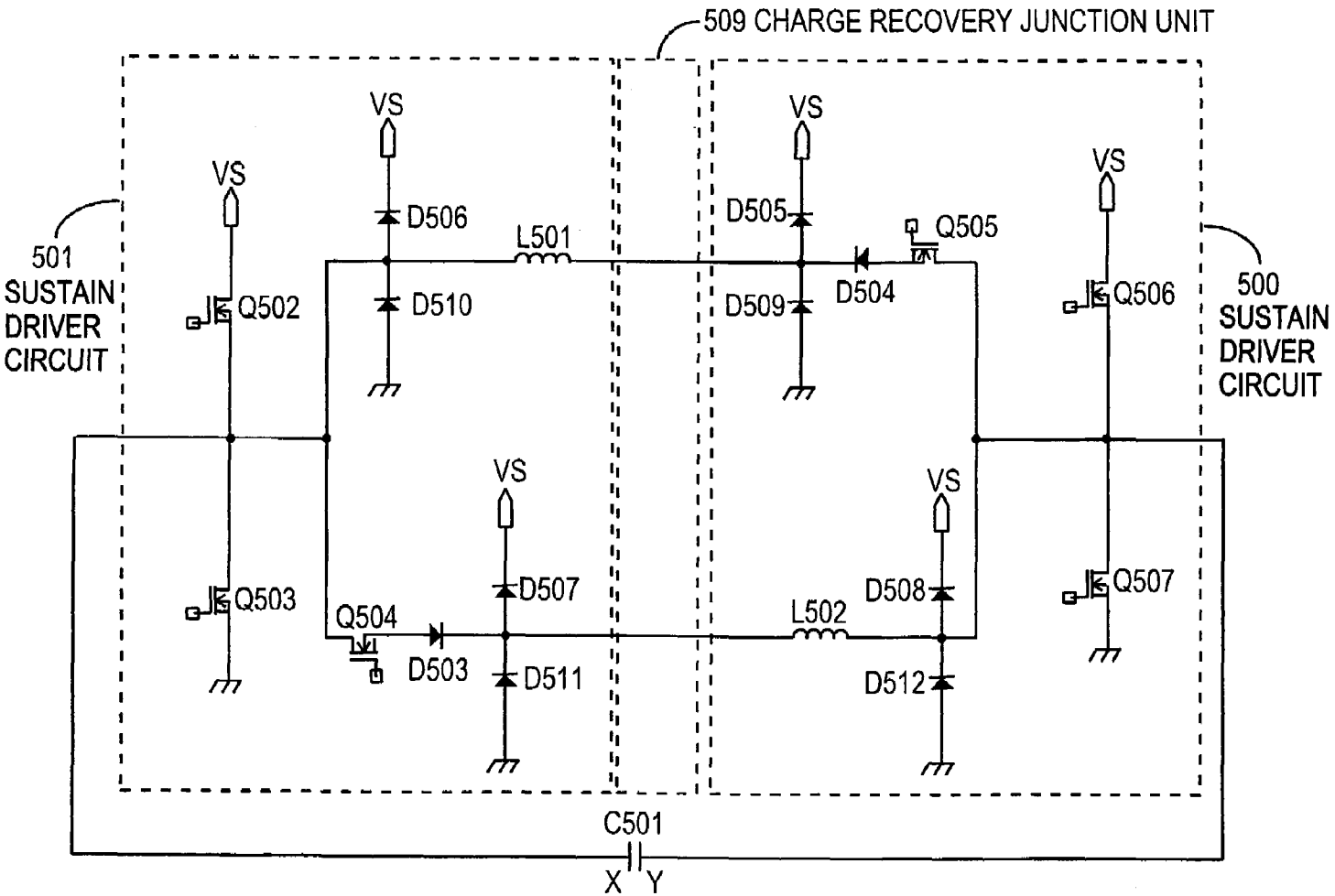
FIG. 10 is a circuit diagram showing the fourth embodiment of the plasma display panel drive circuit of the present invention.

As shown in FIG. 10 and in contrast to the example shown in FIG. 6, sustain driver circuits 100 and 101 of this embodiment are of a configuration in which the positions of diodes D503, D504 and coils L502 and L501 for controlling the direction of the current that flows between the sustain electrode side and scan electrode side have been exchanged.

In this embodiment, diodes D506, D508, D510, and D512 are not necessary and a reduction in costs can be realized if the spike voltage that arises from the counter-electromotive force of the inductance that is present in coils L501 and L502 and charge recovery junction unit 509 can be absorbed in a recovery diode that constitutes transistors Q502, Q503, Q506, Q507.

In the four embodiments described hereinabove, damping resistors may be provided in parallel with coils in combination with clamp diodes for absorbing spike voltage.

Further, although FET transistors were employed as the switching means in the four embodiments described hereinabove, the present invention places no particular limitations on the type of elements as long as the elements are capable of a switching operation. It should be clear that the same effect can be obtained in a case in which n-channel FET transistors are modified to p-channel [FET] transistors.

While preferred embodiments of the present invention have been described using specific terms, such description is for illustrative purposes only, and it is to be understood that changes and variations may be made without departing from the spirit or scope of the following claims.

What is claimed is:

1. A drive circuit of a plasma display panel having scan electrodes and sustain electrodes that realizes display by discharge that is generated by shifting potential between said scan electrodes and said sustain electrodes, comprising:

a first sustain driver circuit for both controlling potential on said scan electrode side and effecting control such that, when said scan electrode side is at the power-supply potential, this potential is used to raise the potential of said sustain electrode side;

a second sustain driver circuit for both controlling potential on said sustain electrode side and effecting control such that, when said sustain electrode side is at the power-supply potential, this potential is used to raise the potential of said scan electrode side;

a control circuit that controls the operation of said first and second sustain driver circuits to repeat shifting of the potential between said scan electrodes and said sustain electrodes; and a junction means for connecting said first sustain driver circuit and said second sustain driver circuit, wherein said first sustain driver circuit comprises:

a first switching element for clamping said scan electrodes to the power-supply potential;

a second switching element for clamping said scan electrodes to the ground potential;

a third switching element for both lowering the potential of said scan electrode side and raising the potential of said sustain electrode side by causing current to flow from said first sustain driver circuit to said second sustain driver circuit when said scan electrode side is at the power-supply potential; and a first coil that is connected between said third switching element and said second sustain driver circuit;

and wherein said second sustain driver circuit comprises:

a fourth switching element for clamping said sustain electrodes to the power-supply potential;

a fifth switching element for clamping said sustain electrodes to the ground potential;

a sixth switching element for both lowering the potential of said sustain electrode side and raising the potential of said scan electrode side by causing a current to flow from said second sustain driver circuit to said first sustain driver circuit when said sustain electrode side is at the power-supply potential; and a second coil that is connected between said sixth switching element and said first sustain driver circuit.

2. A drive circuit of a plasma display panel according to claim 1 wherein:

said first sustain driver circuit includes a first diode that regulates the direction of current that flows between said first sustain driver circuit and said second sustain driver circuit to only the direction from said second sustain driver circuit to said first sustain driver circuit; and said second sustain driver circuit includes a second diode that regulates the direction of current that flows between said second sustain driver circuit and said first sustain driver circuit to only the direction from said first sustain driver circuit to said second sustain driver circuit.

3. A drive circuit of a plasma display panel according to claim 2 wherein said first sustain driver circuit includes a third diode for preventing current from flowing to the power-supply voltage side by way of said first switching element.

4. A drive circuit of a plasma display panel according to claim 2 wherein said second sustain driver circuit includes a fourth diode for preventing current from flowing to the power-supply voltage side by way of said fourth switching element.

5. A drive circuit of a plasma display panel according to claim 2 wherein said first and second sustain driver circuits each includes a group of clamp diodes for absorbing spike voltage that is caused by counter-electromotive force in inductance that is present in said first and second coils as well as in said junction means.

6. A drive circuit of a plasma display panel according to claim 3 wherein said first and second sustain driver circuits each includes a group of clamp diodes for absorbing spike voltage that is caused by counter-electromotive force in inductance that is present in said first and second coils as well as in said junction means.

7. A drive circuit of a plasma display panel according to claim 4 wherein said first and second sustain driver circuits each includes a group of clamp diodes for absorbing spike voltage that is caused by counter-electromotive force in inductance that is present in said first and second coils as well as in said junction means.

8. A drive circuit of a plasma display panel according to claim 5 wherein:

said first diode is provided on the side of said first and second switching elements from said clamp diode group; and said second diode is provided on the side of said fourth and fifth switching elements from said clamp diode group.

9. A drive circuit of a plasma display panel according to claim 6 wherein:

said first diode is provided on the side of said first and second switching elements from said clamp diode group; and said second diode is provided on the side of said fourth and fifth switching elements from said clamp diode group.

10. A drive circuit of a plasma display panel according to claim 7 wherein:

said first diode is provided on the side of said first and second switching elements from said clamp diode group; and said second diode is provided on the side of said fourth and fifth switching elements from said clamp diode group.

11. A drive circuit of a plasma display panel according to claim 1 wherein said switching elements are FET transistors.

12. A drive circuit of a plasma display panel according to claim 2 wherein said switching elements are FET transistors.

13. A drive circuit of a plasma display panel according to claim 3 wherein said switching elements are FET transistors.

14. A drive circuit of a plasma display panel according to claim 4 wherein said switching elements are FET transistors.

15. A drive circuit of a plasma display panel according to claim 5 wherein said switching elements are FET transistors.

16. A drive circuit of a plasma display panel according to claim 6 wherein said switching elements are FET transistors.

17. A drive circuit of a plasma display panel according to claim 7 wherein said switching elements are FET transistors.

18. A drive circuit of a plasma display panel according to claim 8 wherein said switching elements are FET transistors.

19. A drive circuit of a plasma display panel according to claim 9 wherein said switching elements are FET transistors.

20. A drive circuit of a plasma display panel according to claim 10 wherein said switching elements are FET transistors.

* * * * *